US008869577B2

(12) United States Patent
Ritter et al.

(10) Patent No.: US 8,869,577 B2
(45) Date of Patent: Oct. 28, 2014

(54) MEASURING DEVICE, ROLL STAND AND METHOD OF DETECTING THE HEIGHT OF A ROLL GAP

(75) Inventors: Andreas Ritter, Haiger (DE); Markus Koch, Hilchenbach (DE); Andreas Berendes, Kirchhundem (DE)

(73) Assignee: SMS Siemag AG, Duesseldorf (DE)

( * ) Notice: Subject to any disclaimer, the term of this patent is extended or adjusted under 35 U.S.C. 154(b) by 0 days.

(21) Appl. No.: 14/123,560

(22) PCT Filed: May 16, 2012

(86) PCT No.: PCT/EP2012/059088

§ 371 (c)(1),
(2), (4) Date: Feb. 10, 2014

(87) PCT Pub. No.: WO2012/168046

PCT Pub. Date: Dec. 13, 2012

(65) Prior Publication Data

US 2014/0150508 A1 Jun. 5, 2014

(30) Foreign Application Priority Data

Jun. 7, 2011 (DE) ..... 10 2011 105 331
Jun. 27, 2011 (DE) ..... 10 2011 078 139

(51) Int. Cl.
*B21B 37/58* (2006.01)
*B21B 38/10* (2006.01)
*B21B 31/20* (2006.01)

(52) U.S. Cl.
CPC *B21B 38/10* (2013.01); *B21B 31/20* (2013.01)
USPC ..... 72/10.7

(58) Field of Classification Search
CPC ..... B21B 37/58; B21B 38/10
USPC ..... 72/10.1, 10.7, 12.1, 13.4, 17.2, 20.1, 72/240, 248
See application file for complete search history.

(56) References Cited

U.S. PATENT DOCUMENTS 2,032,584 A 3/1936 Lengel
3,046,686 A 7/1962 Fogle
3,646,686 A 3/1972 Kreiskorte
(Continued)

FOREIGN PATENT DOCUMENTS

DE 24 04 763 8/1975
EP 698 428 2/1996
(Continued)

OTHER PUBLICATIONS

Vollmer Cross Profile Gauge VBP.

*Primary Examiner* — Debra Sullivan
(74) *Attorney, Agent, or Firm* — Abelman, Frayne & Schwab

(57) ABSTRACT

The invention relates to a measuring device, a roll stand and a method for detecting the height of a roll gap between two working rolls in the roll stand. In order to ensure a high level of measurement accuracy of the roll gap transmitter even in the case of horizontal displacement of the working rolls in or against the rolling direction it is proposed in accordance with the invention to carry out adjusting the movement of the roll gap transmitter (110) with respect to the working rolls in the case of a displacement in or against the rolling direction so that even in a new or displaced end position of the working rolls a suitable relative position, which is required for a high level of measurement accuracy, between roll gap transmitter and the working rolls is guaranteed.

16 Claims, 8 Drawing Sheets

(56) References Cited

U.S. PATENT DOCUMENTS

| | | | |
|---|---|---|---|
| 4,044,580 | A | 8/1977 | Worden |
| 4,148,145 | A | 4/1979 | Hoelter |
| 4,575,945 | A | 3/1986 | Rigler |
| 7,174,758 | B2 | 2/2007 | Taeuber |
| 2002/0078729 | A1 | 6/2002 | Bunten |

FOREIGN PATENT DOCUMENTS

| | | |
|---|---|---|
| EP | 1 206 981 | 10/2001 |
| GB | 886 238 | 1/1962 |
| WO | 03 045 598 | 6/2003 |

MEASURING DEVICE, ROLL STAND AND METHOD OF DETECTING THE HEIGHT OF A ROLL GAP

BACKGROUND OF THE INVENTION

1. Field of the Invention

The invention relates to a measuring device with a roll gap transmitter for direct detection of the height or the size of a roll gap between two working rolls in a roll stand. The invention additionally relates to the associated roll stand and a corresponding method.

2. Description of the Prior Art

A measuring device for detecting the gap of a working roll pair as an actual value for a regulator for keeping the height of the roll gap between the working rolls constant is known from German Patent Specification DE 24 04 763 C2. The measuring device comprises a measuring head which is aligned in the roll gap with the help of a scissor lever pair biased with the assistance of tension springs. The measuring head is held at the roll stand by way of a pivotable linkage. The measuring head comprises two electromagnetic measuring systems, which each detect the spacing of the individual reference plane from the associated shaft projection acting as a magnet. Through the pivotable linkage, which is dimensioned to be substantially longer by comparison with the height of the measuring head, it is ensured that uniform vertical movements of the working rolls such as, for example, vibrations are virtually without influence on the measurement result, because the spacing of each reference plane of the electromagnetic measuring systems from the associated shaft projection can be kept constant by the measuring device.

It is disadvantageous with this prior art that the pivotable linkage is merely designed to cause the measuring device or the measuring head to track a vertical movement of the working rolls in order to keep the spacing between measuring head and shaft projection of the working rolls constant. Problems with a horizontal movement of the working rolls in or against the rolling direction are not discussed.

U.S. Pat. No. 2,032,584 discloses a roll gap transmitter for detecting the height of the roll gap between two working rolls for a manual operation. It is not coupled with the roll stand and therefore cannot be used in any desired position of the working roll pair.

Finally British Patent Application GB 886 238 discloses a measuring device for measuring the size of the roll gap between two working rolls. The measuring device comprises two measuring rolls which are mounted by a common mount and are brought into contact with the surface of the working rolls for measurement of the size of the roll gap. The measuring rolls are biased by way of a linkage and a compression spring in the direction of the rolling gap plane which is spanned by the two longitudinal axes of the working rolls. The biasing represents a working point of the compression spring. Any change in the size of the roll gap, i.e. any vertical movement of the working rolls relative to one another, leads to a change in the spring force with respect to the working point. This change in the spring force, which represents a change in the size of the roll gap, is displayed on a display device.

The measuring device according to the British patent application serves, as stated, for detecting vertical movements of the working rolls relative to one another, i.e. a change in size of the roll gap with unchanged horizontal position of the working rolls. A displacement of the working rolls in or against the rolling direction would have the consequence of displacement of the working point of the spring and thus an increasing level of measurement inaccuracy. Starting from this prior art the invention has the object of developing a known measuring device as well as a known roll stand with the measuring device in such a way that the measuring device still supplies satisfactorily usable measurement results, without losses in measurement accuracy, even in the case of displacement of the working rolls in or against the rolling direction.

SUMMARY OF THE INVENTION

This object is achieved by providing a measuring device that comprises a roll gap transmitter for detecting the height of a roll gap between two working rolls in a roll stand in a suitable relative position of the roll gap transmitter with respect to the working rolls, an initialization device for detection of a displacement of the working rolls in or against the rolling direction from a starting position to an end position and a roll gap transmitter displacing device for displacing the roll gap transmitter in dependence on the displacement, which is detected by the initialization device, of the working rolls in or against the rolling direction into the relative position, which is suitable for detection of the height of the rolling gap, with respect to the working rolls in the end position.

The term "roll gap transmitter" means, in the case of the present invention, a roll gap transmitter for direct detection of the height or size of the roll gap, i.e. the roll gap transmitter is constructed for direct introduction into the roll gap or between the roll pins or the Lynette seats of the rolls.

The term "displacement of the working rolls" is to be understood in the case of the present invention in the sense of a displacement vector, i.e. it denotes an amount and a direction.

The term "suitable relative position of the roll gap transmitter with respect to the working rolls" designates, in particular, a suitable spacing between a measuring head of the roll gap transmitter with respect to the surface of the working rolls or the Lynette seat thereof for detection, which is as accurate as possible, of the position of an individual working roll or for detection of the spacing of two working rolls from one another. Only maintenance of the correct/suitable relative position ensures a desired high level of measuring accuracy.

With the help of the initialization device which is provided in accordance with the invention and which is constructed to detect displacement of the working rolls in or against the rolling direction it is possible, in the case of a displacement of the working rolls in or against the rolling direction from an initial position to an end position, to cause the roll gap transmitter to track the working rolls in the end position so that even in the end position a suitable relative position between the roll gap transmitter and the working rolls and thus a requisite high level of measurement accuracy are guaranteed.

According to first embodiment the initialization device is constructed in the form of a mechanical coupling point, a scanning head or an optical, electronic or magnetic sensor for detection of a change in the position of at least one of those elements of the mounting of the working rolls which in the case of a displacement in or against the rolling direction are conjunctively displaced. By contrast with a rigid fixing of the roll gap transmitter at the roll stand, the provision of the initialization device and the operative connection thereof with the conjunctively displaced parts of the mounting enable optimum detection of the displacement of the working rolls in or against the rolling direction.

The parts, which are conjunctively displaced in or against the rolling direction, of the mounting of the working rolls are the part, which is at the roll side, of a horizontal shifting (HS)

displacing device, an intermediate plate, a bending cassette or the chock, i.e. the bearing housing of the working rolls in the roll stand.

In cases in which the initialization device is constructed in the form of a scanning head or one of the mechanical coupling points, thus stands in direct contact with the co-displaced parts of the mounting, the roll gap transmitter displacing device is preferably constructed in the form of a mechanical linkage for direct synchronous transmission of the displacement movement of the conjunctively displaced parts of the mounting of the working roll to the roll gap transmitter. In this embodiment there is usually no requirement for an additional drive for causing adjusting movement of the roll gap transmitter with respect to the working rolls because the displacing work for the roll gap transmitter can in this case be conjunctively exerted by the HS displacing device for the working rolls.

The linkage can be constructed to be pivotable by way of coupling points.

Alternatively, the mechanical coupling point in the linkage can, however, also be constructed together as a rigid connection between one of the conjunctively displaced parts of the mounting of the working rolls and the roll gap transmitter.

Alternatively to a direct transmission of the displacing movements of individual ones of the conjunctively displaced parts of the mounting to the working rolls via a mechanical linkage this transmission can also be carried out contactlessly, preferably if the initialization device is constructed in the form of an optical, electrical or magnetic sensor and an optical or electrical transmission channel is provided for transmission of the measurement signals of the initialization device, which represent the displacement of the working rolls in or against the rolling direction, to a controlling and drive device for displacement of the roll gap transmitter.

The above-mentioned object of the invention is additionally fulfilled by a roll stand with the claimed measuring device. The advantages of this solution substantially correspond with the advantages mentioned above with respect to the claimed measuring device.

In addition, it may be mentioned that the roll stand can also comprise, apart from the HS displacing device for displacing the working rolls in or against the rolling direction, an axial displacing device for axial displacement of the working rolls. A conjunctive displacement of the roll gap transmitter in axial direction together with the working rolls is not provided in accordance with the invention because in the case of an axial displacement of the working rolls the relative position required for detection of the roll gap, i.e. the spacing between the roll gap transmitter and the surface of the working rolls or the surface of the Lynette seat thereof, does not change, particularly if the Lynette seat has a constant diameter.

Finally it is advantageous if the roll gap transmitter displacing device has an operating mode for retraction of the roll gap transmitter into a rest or retracted position outside the roll gap and preferably also outside the roll stand.

The above-mentioned object is finally also fulfilled by a method for measuring the height of the roll gap. The advantages of this method also correspond with the above advantages discussed with respect to the measuring device.*

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments of a rotor/rotor shaft connection, when read with reference to the accompanying drawings.

DETAILED DESCRIPTION OF THE PREFERRED EMBODIMENTS

The invention is described in detail in the following with reference to the mentioned FIGS. 1 to 5. However, the prior art, on which the invention is based, is described beforehand with reference to FIGS. 6 to 8.

Figure 6:
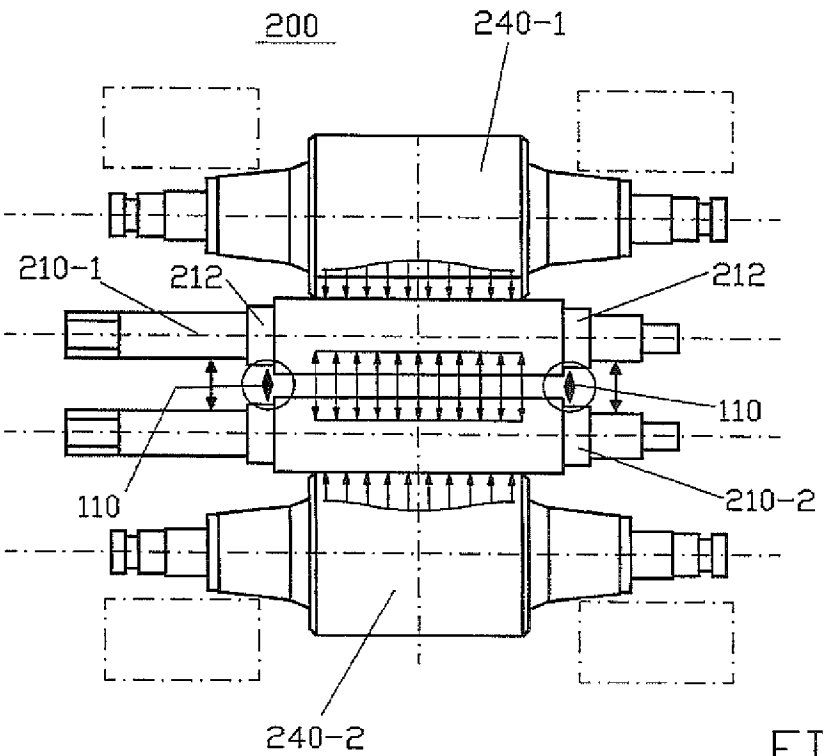
FIG.6 Prior Art
FIG. 6 shows a roll stand according to the prior art with an arrangement of the roll gap transmitter at the Lynette seats of the working rolls.
Figure 7:
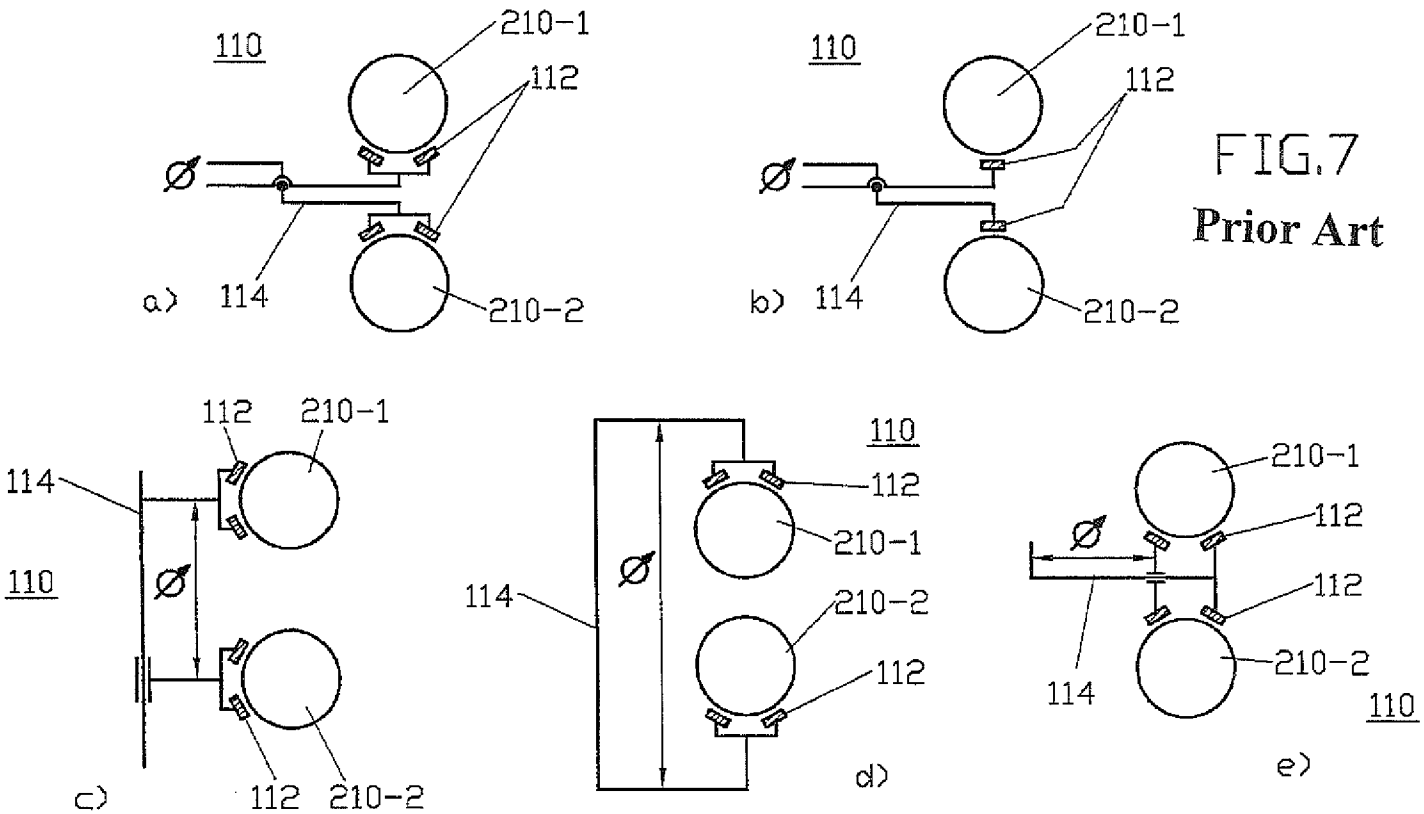
FIG.7 Prior Art
FIG. 7*a-e* show different forms of embodiment for roll gap transmitters and for the arrangement thereof relative to the working rolls in accordance with the prior art.

FIG. 6 shows a roll stand of the prior art with two backing rolls 240-1, 240-2 between which two working rolls 210-1, 210-2 are mounted. The spacing between the two working rolls defines a roll gap through which rolling stock (not shown here) is moved in rolling direction. Roll gap transmitters 110 for detection of the height of the roll gap are arranged at the Lynette seats 212 of the working rolls. Because the Lynette seats are typically offset relative to the diameter of the rolls, the spacing, which is detected by the roll gap transmitter, between the Lynette seats and the reduced—due the larger diameter of the working rolls—height H of the roll gap obviously has to be calculated hereunder.

FIGS. 7*a*) to 7*e*) show different forms of embodiment for roll gap transmitters 110 known in the prior art. All of these roll gap transmitters have a mechanism 114 in the form of a linkage for suitable positioning of measuring heads 112 with respect to the Lynette seats of the working rolls 210. The mechanism or the linkage is typically biased with the help of a spring so that in this manner a respective predetermined spacing between measuring head and Lynette seat or surface of the working roll or a bearing of the measuring head against the Lynette seat or against the working roll is always guaranteed even in the case of vertical movement of the working rolls 210.

Figure 8:
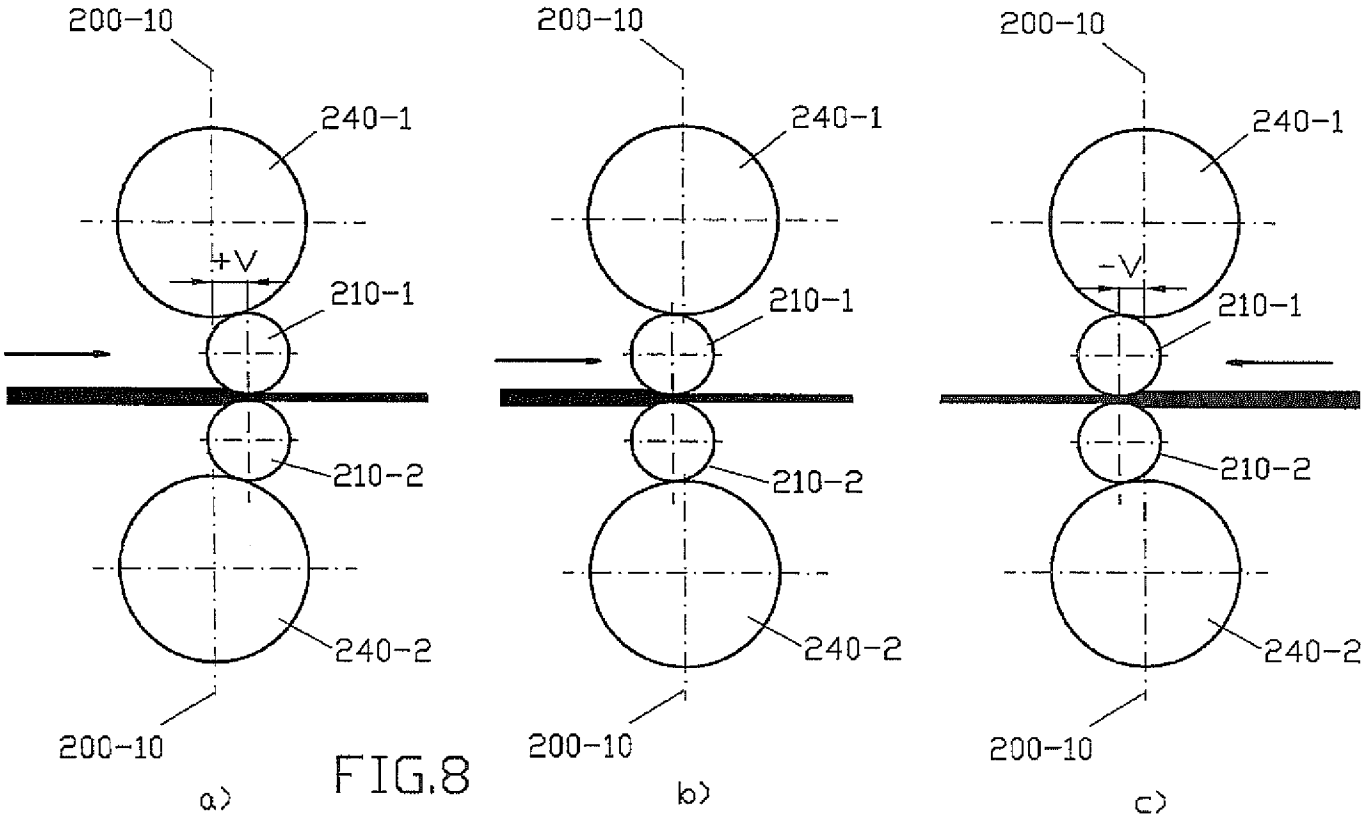
FIG.8 Prior Art
FIG. 8*a-c* show different examples for an HS displacement of the working rolls with respect to the stand plane according to the prior art.

FIGS. 8*a*), *b*) and *c*) respectively show different examples for a displacement V of the working rolls 210 relative to the stand plane 200-10. The stand planes are respectively spanned by the longitudinal axes of the upper and lower backing rolls 240-1, 240-2. As FIGS. 8*a*), *b*) and *c*) show, the working rolls 210 and thus the roll gap can be displaced not only in rolling direction, but also against the rolling direction with respect to the stand plane 210. The amount of the displacement, i.e. the offset, is denoted in the figures by the reference symbol V. The direction of the offset with respect to the stand plane 200-10 is characterized by a corresponding sign + or −. The rolling direction is respectively characterized in FIG. 8 by a horizontal arrow.

Figure 1:
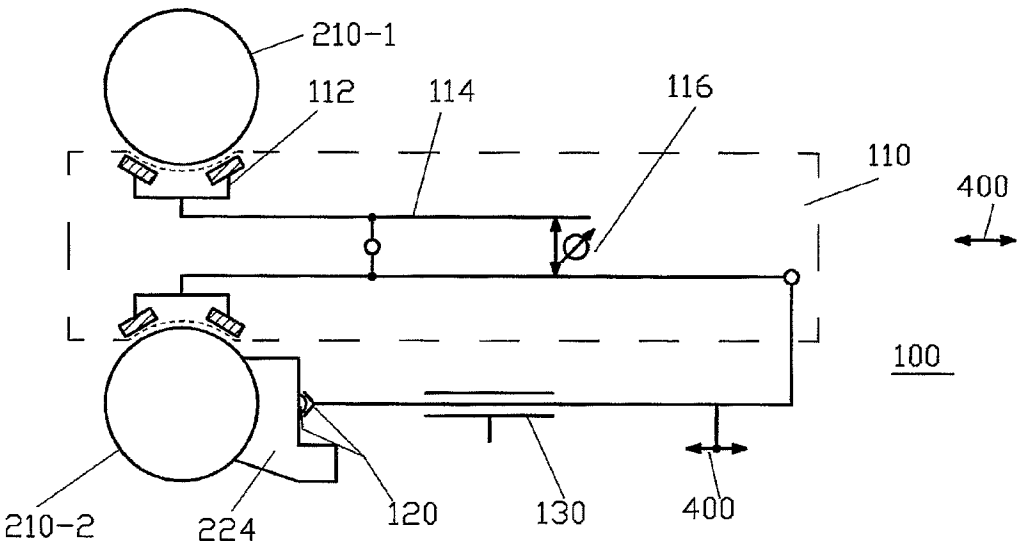
FIG. 1 shows an embodiment of a measuring device according to the present invention in a cross-section.

The description of the invention follows:

FIG. 1 shows the measuring device 100 according to the invention arranged in the roll gap of a roll stand between the upper working roll 210-1 and the lower working roll 210-2. The measuring device 200 comprises a roll gap transmitter 110 for detecting the height of the roll gap between the two working rolls. The measuring device 100 additionally comprises an initialization device 120 for detecting a displacement of the working rolls 210 in or against the rolling direction from a starting position to an end position. The rolling direction is characterized in FIG. 1 by the double arrow.

The roll gap transmitter 110 comprises, according to FIG. 1, measuring heads 112 which are arranged in a suitable relative position with respect to the circumference of the working rolls 210-1, 210-2 or with respect to the circumference of the Lynette seat of the working rolls. The measuring heads 112 are connected by way of a linkage 114 with a display device 116 which displays the height of the working gap. The initialization device 120 is connected by at least one half thereof with the chock 224 of the lower working roll 210-2. The initialization device 120 in the case of the embodiment shown in FIG. 1 acts by way of a roll gap transmitter displacing device 130 directly on the roll gap transmitter 110. The roll gap transmitter displacing device 130 comprises, in the case of the embodiment shown in FIG. 1, a linkage which is displaceably mounted in a slide sleeve. Through the direct coupling of the chock 224 by way of the initialization device 120 and the roll gap transmitter displacing device 130 to the roll gap transmitter 110 a displacement of the chock 224 and thus of the working rolls 210 in or against the rolling direction is advantageously transmitted directly synchronously to the roll gap transmitter 110. In this manner it is advantageously ensured that even in the case of displacement of the working rolls in or against the rolling direction the relative position of the measuring heads 112 with respect to the surfaces of the working rolls 210 or the Lynette seats (not shown in FIG. 1) and thus a desired measurement accuracy are maintained.

Figure 2:
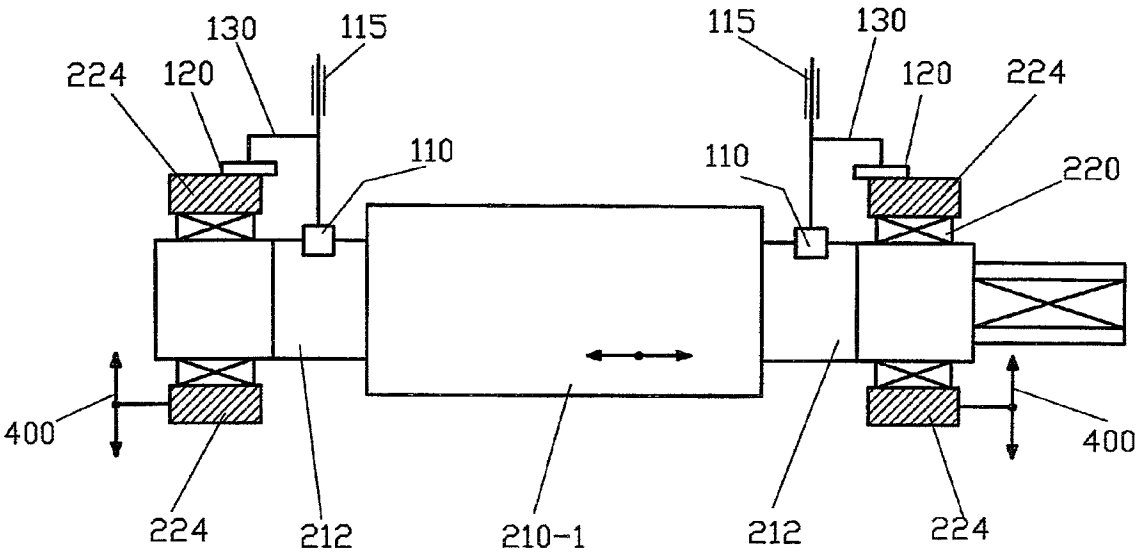
FIG. 2 shows the measuring device according to the invention in a plan view.

FIG. 2 shows a plan view of the arrangement known from FIG. 1. The arrangement of the roll gap transmitters 110 at the lefthand and righthand Lynette seats 212 of the working roll 210-1 can be seen. The roll gap transmitters 110 are connected by way of the roll gap transmitter displacing device 130 with the initialization device 120, which in turn directly contacts the chock 224 of the working roll 210. The roll gap transmitter displacing device 130 has a degree of freedom in or against the rolling direction, recognizable at the arrangement of the displacing sleeve 115 parallel to the rolling direction 400.

Figure 3:
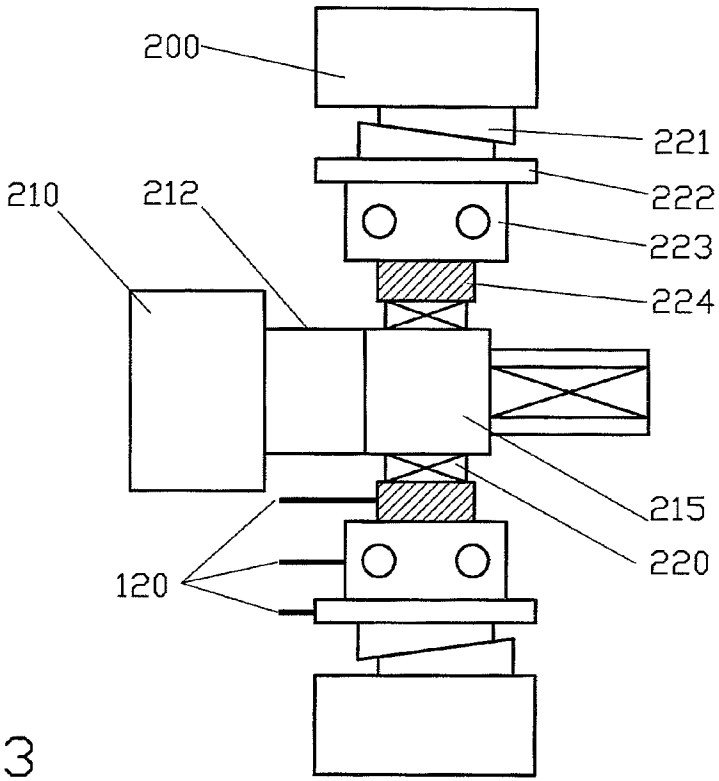
FIG. 3 shows the mounting of a working roll with different details.

FIG. 3 shows individual elements of a mounting of the working roll 210 in detail. The mounting serves for bridging over the spacing between the housings of the stand and the roll pins 215 of the working roll 210. The spacing therebetween is occupied by a horizontal shifting (HS) displacing device in the form of, for example, a wedge adjustment. In the case of the embodiment shown in FIG. 3, the HS displacing device comprises a first wedge firmly connected with the housing of the roll stand 200 and a second wedge 221 sliding on the first wedge. A intermediate plate 222, a bending cassette 223 and/or a chock 224 is or are typically connected with the wedge 221 in the direction of the roll pin of the working roll.

All mentioned parts of the mounting, i.e. the movable wedge 221, the intermediate plate 222, the bending cassette 223 and the chock 224, can each individually serve as a reference point for the initialization device 120 for detection of a displacement of the working rolls, because in this case the stated individual parts of the mounting are conjunctively moved in or against the rolling direction.

Figure 4:
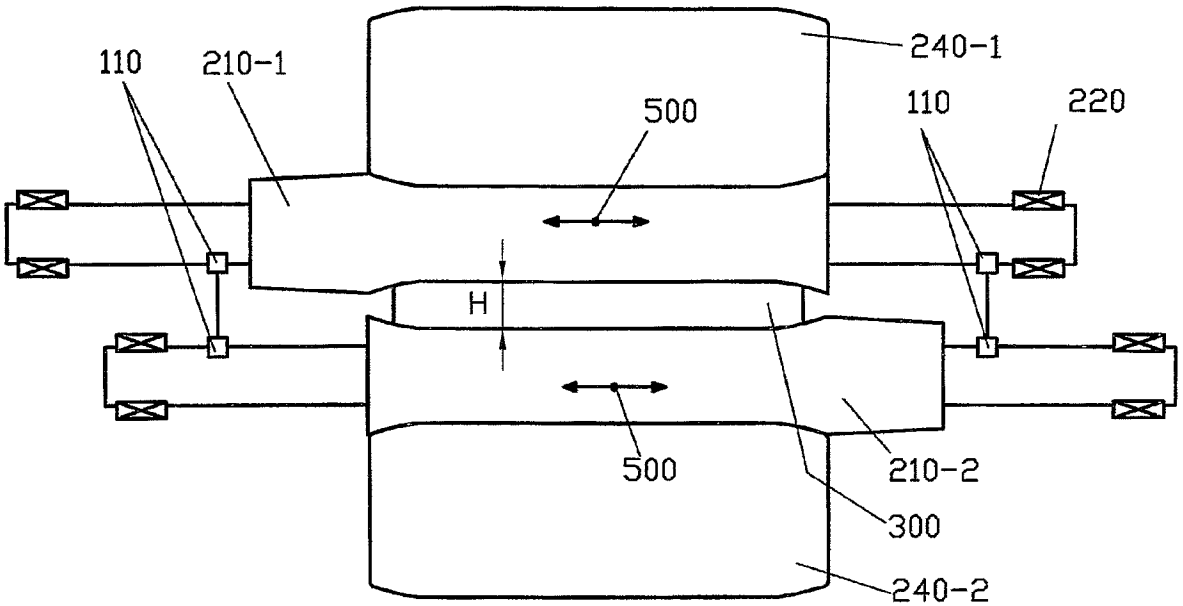
FIG. 4 shows the arrangement of the measuring device according to the invention in a roll stand in the case of axial displacement of the working rolls.

In FIG. 4 it can be seen that even in the case of an axial displacement 500 of the working rolls 210 the roll gap transmitters 110 do not have to be conjunctively axially displaced insofar as the axial displacement has no effects on the relative position of the roll gap transmitters 110 with respect to the Lynette seats or the roll pins of the working rolls, so that the relative position, which is required for a desired measurement accuracy, of the roll gap transmitters with respect to the Lynette seats are maintained.

Figure 5:
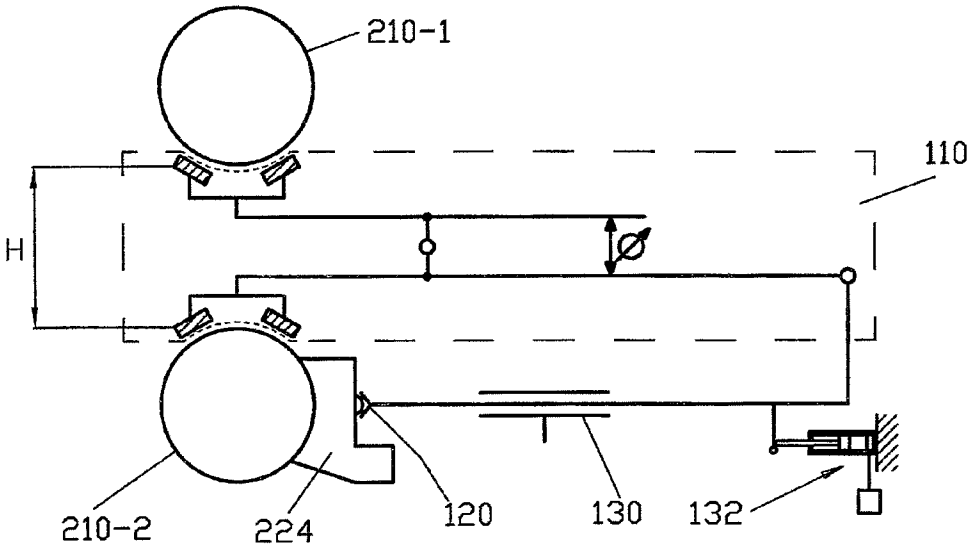
FIG. 5 shows the measuring device according to the invention in cross-section with a controlling and drive device for displacing the roll gap transmitter.

By contrast to FIG. 1, FIG. 5 shows an embodiment for the measuring device according to the invention in which the roll gap transmitter displacing device 130 also comprises a controlling and drive device 132, which is constructed for moving the roll gap transmitter 110 actively in or against the rolling direction. This controlling and drive device 132 is required particularly if a direct mechanical coupling between the chock 224 and the roll gap transmitter 110 is not present. This can be the case, for example, if the initialization device 120 consists of two mechanically separate coupling halves of which one, for example, is connected with the chock 224 and the other with a linkage of the roll gap transmitter displacing device 130. Alternatively, the controlling and drive device 132 can be required if the roll gap transmitter displacing device 130 does not provide a mechanism or a linkage between the initialization device and the roll gap transmitter 110, but provides instead an optical or electrical transmission channel for transmission of the measurement signals of the initialization device, which represent the displacement of the working rolls, to the controlling and drive device. In both cases the controlling and drive device 132 serves for active adjustment of the roll gap transmitter 110 with respect to the displaced (end) position of the working rolls. In addition, the roll gap transmitter displacing device 130 together with the controlling and drive device 132 can have an operating mode for retracting the roll gap transmitter 110 into a rest or retracted position outside the roll gap and preferably also outside the roll stand. The adjustment of the roll gap transmitter with respect to the working rolls can take place simultaneously, i.e. synchronously, with or displaced in time with respect to the displacement of the working rolls 210.

REFERENCE NUMERAL LIST

100 measuring device
110 roll gap transmitter
112 measuring head
114 mechanism
120 initialization device
130 roll gap transmitter displacing device
132 controlling and drive device
200 roll stand
210-1 upper working roll
210-2 lower working roll
212 Lynette seat
215 roll pin
220 mounting of the working rolls
221 roll-side part of an HS displacing device
222 intermediate plate
223 bending cassette
224 chock (=bearing housing) of the working roll
240-1 backing roll
240-2 backing roll
300 rolling stock
400 rolling direction=HS displacement direction
500 axial displacement direction H roll gap height +V positive offset relative to stand plane −V negative offset relative to stand plane

What is claimed is:

1. Measuring device (100) with a roll gap transmitter (110) for detecting a height (H) of a roll gap between two working rolls (210-1, 210-2) in a roll stand (200) when the roll gap transmitter (110) is in a suitable relative position with respect to the working rolls; an initialization device (120) for detecting displacement of the work rolls in or against a rolling direction from a starting position to an end position; and a roll gap transmitter displacing device (130) for displacing the roll gap transmitter (110) in dependence on the displacement, which is detected by the initialization device (120), of the working rolls in or against the rolling direction into the relative position, which is suitable for detecting the height of the roll gap, with respect to the working rolls in the end position.

2. Measuring device (100) according to claim 1, characterized in that the initialization device (120) is constructed in the form of a mechanical coupling point, a scanning head or an optical, electronic or magnetic sensor for detecting a change in a position of at least one element of a mounting (220) of the working rolls which in the case of displacement of the working rolls (210-1, 210-2) in or against the rolling direction, are conjunctively displaced and the displacement of which accordingly represents the displacement of the working rolls.

3. Measuring device (100) according to claim 2, characterized in that the elements of the mounting (220), which in the case of displacement of the working rolls in or against the rolling direction are conjunctively displaced, are a part (221), which is at a roll side of a horizontal shifting displacing device, an intermediate plate (222), a bending cassette (223), or a chock (224) of the working rolls in the roll stand.

4. Measuring device (100) according to claim 2, characterized in that in cases in which the initialization device is constructed in the form of the scanning head or the mechanical coupling point, the roll gap transmitter displacing device (130) is constructed in form of a mechanical linkage for direct synchronous transmission of the displacement movement of the conjunctively displaced elements of the mounting (220) of the working rolls (210-1, 210-2) to the roll gap transmitter (110).

5. Measuring device (110) according to claim 4, characterized in that the mechanical coupling point and the linkage are constructed in common as a rigid connection between the conjunctively displaced parts of the mounting of the working rolls and the roll gap transmitter.

6. Measuring device (100) according to claim 2, characterized in that in cases in which the initialization device is constructed in the form of the optical, electrical or magnetic sensor, the roll gap transmitter displacing device (130) comprises a controlling and drive device (132) for displacement of the roll gap transmitter (110) in or against the rolling direction and an optical or electrical transmission channel for transmission of the measurement signals of the initialization device, which represent the displacement of the working rolls, to the controlling and drive device (132), which is constructed to displace the roll gap transmitter into the relative position, which is suitable for detection of the height of the roll gap, with respect to the working rolls in the end position in response to the measurement signals.

7. Roll stand (200) comprising two working rolls (210-1, 210-2), which span a rolling gap for rolling a metal strip; and a horizontal shifting displacing device (230) for displacing the working rolls in or against a rolling direction from a starting position to an end position;

characterized by a roll gap transmitter (110) for detecting a height (H) of a roll gap between the two working rolls (210-1, 210-2) when the roll gap transmitter is in a suitable relative position with respect to the working rolls;

an initialization device (120) for detecting the displacement of the work rolls in or against the rolling direction from the starting position to the end position; and a roll gap transmitter displacing device (130) for displacing the roll gap transmitter (110) in dependence on the displacement, which is detected by the initialization device, of the working rolls in or against the rolling direction into the relative position, which is suitable for detecting the height of the roll gap, with respect to the working rolls in the end position.

8. Roll stand (200) according to claim 7, characterized in that the initialization device (120) is constructed in the form of a mechanical coupling point, a scanning head or an optical, electronic or magnetic sensor for detecting a change in a position of at least one of elements of a mounting (220) of the working rolls which in the case of displacement of the working rolls (210-1, 210-2) in or against the rolling direction, are conjunctively displaced and the displacement of which accordingly represents the displacement of the working rolls.

9. Roll stand (200) according to claim 8, characterized in that the elements of the mounting (220), which in the case of displacement of the working rolls in or against the rolling direction are conjunctively displaced, are a part (221), which is at a roll side of a horizontal shifting displacing device, an intermediate plate (222), a bending cassette (223) or a chock (224) of the working rolls in the roll stand.

10. Roll stand (200) according to claim 8, characterized in that in cases in which the initialization device is constructed in the form of the scanning head or the mechanical coupling point the roll gap transmitter displacing device (130) is constructed in the form of a mechanical linkage for direct synchronous transmission of the displacement movement of the conjunctively displaced elements of the mounting (220) of the working rolls (210-1, 210-2) to the roll gap transmitter (110).

11. Roll stand (200) according to claim 10, characterized in that the mechanical coupling point and the linkage are constructed in common as a rigid connection between the conjunctively displaced elements of the mounting of the working rolls and the roll gap transmitter.

12. Roll stand (200) according to claim 8, characterized in that in cases in which the initialization device is constructed in the form of the optical, electrical or magnetic sensor, the roll gap transmitter displacing device (130) comprises a controlling and drive device (132) for displacement of the roll gap transmitter (110) in or against the rolling direction, and an optical or electrical transmission channel for transmission of the measurement signals of the initialization device, which represent the displacement of the working rolls, to the controlling and drive device (132), which is constructed to displace the roll gap transmitter into the relative position, which is suitable for detection of the height of the roll gap, with respect to the working rolls in the end position in response to the measurement signals.

13. Roll stand according to claim 7, characterized in that the roll gap transmitter displacing device has an operating mode for retracting the roll gap transmitter into a retracted position outside the roll gap and/or the roll stand.

14. Roll stand according to claim 7, characterized in that the roll stand comprises an axial displacing device for axial displacement of the working rolls.

15. Method of measuring the height of a roll gap (H) between two working rolls in a roll stand (200), comprising the following steps:

positioning the working rolls (210-1, 210-2) in a starting position;

positioning a roll gap transmitter (110) in a relative position, which is suitable for detecting a height of the roll gap, with respect to the working rolls in the starting position;

detecting displacement of the working rolls in or against a rolling direction from the starting position to an end position; and moving the roll gap transmitter in or against the rolling direction in dependence on the detected displacement of the working rolls into the relative position, which is suitable for detecting the height of the roll gap, with respect to the working rolls in the end position.

16. Method according to claim 15, characterized in that the movement of the roll gap transmitter is carried out simultaneously/synchronously with or displaced in time relative to the displacement of the working rolls.

* * * * *